US008768223B2

(12) United States Patent
Leemhuis et al.

(10) Patent No.: US 8,768,223 B2
(45) Date of Patent: Jul. 1, 2014

(54) IMAGING APPARATUS ASSEMBLY WITH PRESSURE EQUALIZATION

(75) Inventors: James Richard Leemhuis, Lexington, KY (US); Gary Neal Hackney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 177 days.

(21) Appl. No.: 13/340,830

(22) Filed: Dec. 30, 2011

(65) Prior Publication Data

US 2013/0170863 A1 Jul. 4, 2013

(51) Int. Cl.
*G03G 15/08* (2006.01)

(52) U.S. Cl.
CPC ..... *G03G 15/0839* (2013.01); *G03G 15/0886* (2013.01); *G03G 2215/067* (2013.01); *G03G 2215/0692* (2013.01)
USPC ..... 399/260; 399/262

(58) Field of Classification Search
CPC ..... G03G 15/0839; G03G 15/0886; G03G 2215/067; G03G 2215/0692
USPC ..... 399/258, 260, 262; 222/DIG. 1
See application file for complete search history.

(56) References Cited

U.S. PATENT DOCUMENTS 4,955,316 A * 9/1990 Asanuma et al. ..... 399/103
5,012,289 A 4/1991 Aldrich et al.
5,089,852 A 2/1992 Manno et al.
5,109,254 A * 4/1992 Oka et al. ..... 399/257
5,485,187 A * 1/1996 Okamura et al. ..... 347/85
5,526,030 A 6/1996 Baldwin et al.
5,758,231 A 5/1998 Coffey et al.
6,778,801 B1 * 8/2004 Dougherty ..... 399/252
6,931,224 B2 8/2005 Foster et al.

(Continued)

FOREIGN PATENT DOCUMENTS

EP 1422577 A2 5/2004
JP 2006-39017 2/2006

OTHER PUBLICATIONS

Co-pending U.S. Appl. No. 13/340,814, filed Dec. 30, 2011.

(Continued)

*Primary Examiner* — Benjamin Schmitt
(74) *Attorney, Agent, or Firm* — Justin M Tromp; John Victor Pezdek

(57) ABSTRACT

An assembly in an imaging apparatus including a developer unit and a toner cartridge having a pressure equalization system for equalizing a pressure differential between a toner reservoir in the toner cartridge and a toner sump of a developer unit containing ingested air. A ducted shutter that opens and closes an exit port on the housing of the toner cartridge in combination with a passageway in fluid communication with a duct in the shutter and the toner reservoir forms an airway, and when the toner cartridge is mated with a developer unit of the imaging apparatus and the shutter is in the open position, exiting toner leaves the cartridge through the exit port and enters the developer unit while air entrained within the developer unit enters the toner reservoir via the exit port and airway equalizing pressure between the toner cartridge and the developer unit.

17 Claims, 11 Drawing Sheets

(56) References Cited

U.S. PATENT DOCUMENTS

| | | | | |
|---|---|---|---|---|
| 7,548,710 | B2 | 6/2009 | Gayne et al. | |
| 7,606,520 | B2 | 10/2009 | Dawson | |
| 2001/0051062 | A1 | 12/2001 | Yanagisawa et al. | |
| 2003/0053826 | A1 | 3/2003 | Bares et al. | |
| 2005/0244193 | A1 | 11/2005 | Amano et al. | |
| 2006/0239722 | A1 | 10/2006 | Tanaka et al. | |
| 2007/0003325 | A1 | 1/2007 | Jung et al. | |
| 2011/0279592 | A1 | 11/2011 | Hibbard et al. | |
| 2012/0301187 | A1 | 11/2012 | Ishikuro et al. | |
| 2013/0170862 | A1 * | 7/2013 | Leemhuis et al. | 399/258 |
| 2013/0170871 | A1 * | 7/2013 | Buchanan et al. | 399/260 |

OTHER PUBLICATIONS

International Search Report and Written Opinion of the International Searching Authority dated Jan. 28, 2013 for PCT Application No. PCT/US12/65144 (5 pages).

Prosecution history of U.S. Appl. No. 13/936,425 including Final Office Action dated Nov. 22, 2013.

Prosecution history of U.S. Appl. No. 13/936,425 including Non-Final Office Action dated Sep. 12, 2013.

Prosecution history of U.S. Appl. No. 13/936,425 including Notice of Allowance dated Feb. 25, 2014.

Prosecution history of U.S. Appl. No. 13/340,814 including Notice of Allowance dated Apr. 3, 2014.

* cited by examiner

IMAGING APPARATUS ASSEMBLY WITH PRESSURE EQUALIZATION

CROSS REFERENCES TO RELATED APPLICATIONS

The present application is related to U.S. patent application Ser. No. 13/340,814, filed Dec. 30, 2011, entitled "Toner Cartridge With Pressure Equalization System" and assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to toner cartridges used in electrophotographic imaging devices such as a printer or multifunction device having printing capability, and in particular to a pressure equalization system used for toner cartridges.

2. Description of the Related Art

In toner cartridge design, it is now common practice to separate the longer lived components from those having a shorter life. This has lead to having the longer lived developing components such as the developer roll, toner adder rolls, doctor blades, the foregoing are also referred to as a developing unit, photoconductive drums, cleaning and charge rollers and a waste bin to be in separate assemblies from the toner cartridge. The toner supply, which is consumed relatively quickly in comparison to the previously described components, is provided in a reservoir in a separate toner cartridge that mates with the developer unit. The toner cartridge has a reduced number of components and is often referred to as a toner bottle even though it is more than a mere bottle for holding toner.

To deliver the toner from the toner cartridge to the developer unit, an auger in the toner cartridge may be used to feed toner from the toner cartridge via an exit port on the toner cartridge into an entry port on the developer unit and into a second auger that disperses the toner within the developer unit. As the toner is drawn out of the cartridge unit, it is augured through a shutter used for sealing the exit port of the toner cartridge when it is not inserted in the imaging apparatus.

While moving toner through the restriction formed by the shutter, auger and exit port, the opening from the exit port into the toner reservoir in the toner cartridge is relatively air tight. A low pressure condition or vacuum-like condition is created in the toner cartridge as toner is removed as air cannot enter to fill the void. If the toner cartridge were viewed as being a pump supplying toner from the toner reservoir, this low pressure condition would be analogous to cavitation in a pump.

In the same manner, as toner is augured into the developer unit, it passes through another shutter used to prevent toner from escaping the developer when the cartridge is not installed in the printer. This opening restricts airflow, therefore, as toner is dispensed into the developer unit, air must be displaced and a positive pressure is created in the developer unit. Further, the rotation of the developer roll causes the developer unit to ingest air further increasing the positive pressure in the developer unit. Toner being delivered from the toner cartridge to the developer unit must travel against this positive pressure gradient. This causes a significant reduction in the flow rate of the toner which can lead to failures such as incorrect cartridge empty indications, developer packing, or developer unit starvation.

This described pressure differential between the toner cartridge and developer unit necessitated that a vent be used to equalize the pressure between the developer unit and the toner cartridge. Previous venting methods for the toner cartridge included having a vent hole through the toner cartridge into the toner reservoir. Labyrinth type vent plugs, vent plugs of a porous material, and even foam tape have been used to vent air into the toner cartridge while preventing toner from escaping the toner cartridge through the vent hole. However, these methods were not successful in equalizing the pressure between the developer unit and the toner cartridge as these vent plug designs and foams tended to become clogged with toner. Further, even with the vent plugs being clear and the toner cartridge no longer in a low pressure state, venting of the higher pressure air in the developer unit back into the toner cartridge was problematic due to the restriction caused by the shutter for the exit port of the toner cartridge still causing the aforementioned pressure differential to exist between the toner cartridge and the developer unit.

In other previous toner cartridge designs, the developer unit and cartridge unit were permanently mated together so there was open fluid communications between the developer unit and the toner reservoir so that the entire system would become pressurized due to the ingestion of air caused by the rotation of the developer roll. In some cases, an internal vent was provided within the permanently mated developer unit and toner reservoir. These cartridges vented the higher internal air pressure to the atmosphere. The vent was typically made out of a porous woven material, such as GORTEX® or VERSAPORE®, or felt. These venting methods were all designed around the principle of letting air out of the cartridge while filtering and restricting toner particles from escaping. They also required the filter to be placed in a position on the cartridge that was not buried under toner. However, faster process speeds, larger toner loads, as well as separating the toner cartridge and developer unit make these methods inadequate.

To solve the pressure differential problem, it would be advantageous to have a pressure equalization system to give air a path to move from a high pressure developer unit to a low pressure toner cartridge through the exit port of the toner cartridge. It would be a further advantage to have such a ducting system be sealable to prevent toner from escaping the toner cartridge during shipping, storage, and when removed from the imaging apparatus. It would be a further advantage to be able to provide a high rate of toner delivery that helps avoid a number of previously mentioned toner delivery failures.

SUMMARY

An assembly for an imaging device comprising a developer unit and a toner cartridge. The developer unit and toner cartridge are positionable so as to be in fluid communication with one another. The developer unit comprising a housing having a toner sump therein for holding a first quantity of toner, the housing having an entry port for receiving toner exiting the toner cartridge, and a shutter mounted on the housing and moveable between a first position where the entry port is closed and a second position where the entry port is in fluid communication with the toner sump. The toner cartridge comprising a housing having a reservoir enclosed therein for holding a second quantity of toner, the housing having an exit port in communication with the reservoir for receiving toner exiting the toner cartridge, a shutter mounted on the housing and moveable between a first position where the exit port is closed and a second position where the exit port is open allowing toner to exit, the shutter having an duct therethrough, the duct having a first end in fluid communication with the exit port when the shutter is in the second position, and a passageway having a first end in fluid communication with a second end of the duct when the shutter is in the second position and a second end in fluid communication with the toner reservoir. When the exit port of the toner cartridge is aligned with the entry port of the developer unit and the shutters of the toner cartridge and the developer unit are in their respective second positions, toner leaves the toner cartridge through the exit port and enters the developer unit through the entry port while air entrained within the toner sump of developer unit exits via the entry port and enters the toner reservoir via the exit port, the duct and the passageway thereby equalizing pressure between the toner cartridge and the developer unit.

In a further form a moveable cover is provided on the second end of the passageway and biased to close the second end of the passageway to prevent toner within the reservoir from entering the passageway, the moveable cover being openable by the air entering the reservoir from the developer unit. The moveable cover may be a reed valve. In another form the passageway further comprises an open-sided channel formed in the housing of the toner cartridge and a resilient film strip enclosing the open-sided channel. The film strip may have a first portion and a second portion, the first portion having an adhesive for adhering the film strip to the housing of the toner cartridge and a second portion at the second end of the passageway forming the moveable cover.

The shutter in the toner cartridge may include a hollow portion extending from an inner end of the shutter toward an outer end of the shutter. The hollow portion may have a first open end and a second closed end and an exit opening through a wall of the hollow portion adjacent the second closed end wherein exiting toner enters the first open end of the hollow cylindrical portion and exits through exit opening when the shutter is in the second position. A duct is positioned between the second closed end of the hollow cylindrical portion and the outer end of the shutter. A deflector rib is located at the second closed end of the hollow cylindrical portion with a portion of the deflector rib extending radially outwardly from the shutter to direct the exiting toner into the exit port and away from the first end of the duct.

The shutter in the developer unit includes a hollow portion extending from an inner end of the shutter in the developer unit toward an outer end of the shutter in the developer unit, the hollow portion having a first open end and a second closed end and an entry opening through a wall of the hollow portion wherein toner enters the entry opening passing through the hollow portion and first open end and into the toner sump when the shutter of the developer unit is in the second position.

In another form the housing has a slot adjacent to the shutter and in communication with the toner sump in the developer housing while the entry opening of the shutter is formed of two or more radially offset sections wherein when the shutter is in the first position the slot is closed and when the shutter is in the second position, at least one of the two or more radially offset sections of the entry opening is aligned with the slot in the housing.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
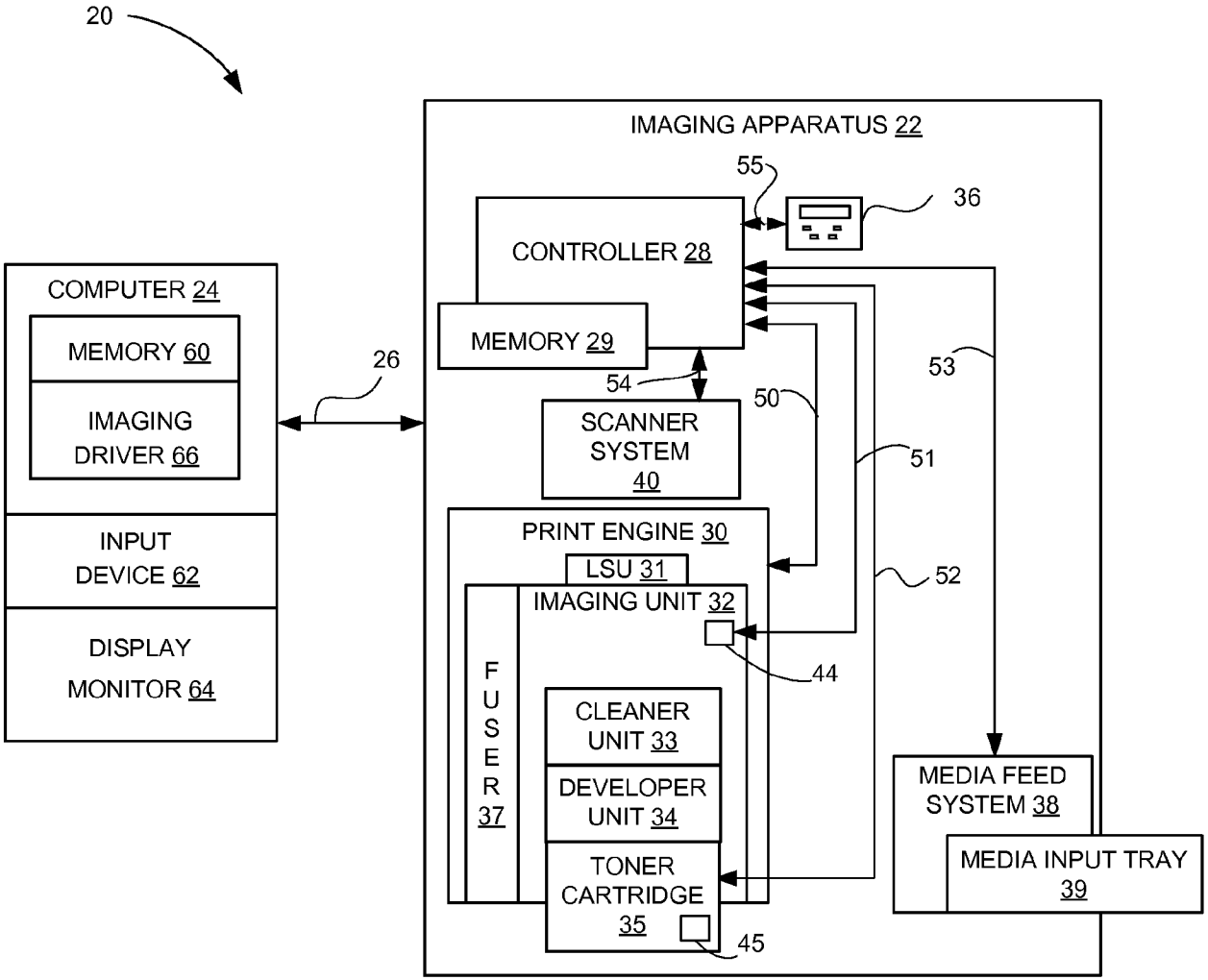
FIG. 1 is a block diagram of an example imaging system utilizing the imaging unit of the present invention.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an imaging device. The terms "left" and "right" are as viewed with respect to the insertion direction of a unit into the imaging device. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The term "image" as used herein encompasses any printed or digital form of text, graphic, or combination thereof. The term "output" as used herein encompasses output from any printing device such as color and black-and-white copiers, color and black-and-white printers, and so-called "all-in-one devices" that incorporate multiple functions such as scanning, copying, and printing capabilities in one device. The term "button" as used herein means any component, whether a physical component or graphic user interface icon, that is engaged to initiate output.

Referring now to the drawings and particularly to FIG. 1, there is shown a diagrammatic depiction of an imaging system 20 embodying the present invention. As shown, imaging system 20 may include an imaging apparatus 22 and a computer 24. Imaging apparatus 22 communicates with computer 24 via a communications link 26. As used herein, the term "communications link" is used to generally refer to structure that facilitates electronic communication between multiple components, and may operate using wired or wireless technology and may include communications over the Internet. Imaging system 20 may be, for example, a customer imaging system, or alternatively, a development tool used in imaging apparatus design.

In the embodiment shown in FIG. 1, imaging apparatus 22 is shown as a multifunction machine that includes a controller 28, a print engine 30, a laser scan unit (LSU) 31, an imaging unit 32, a cleaner unit 33, a developer unit 34, a toner cartridge 35, a user interface 36, a media feed system 38 and media input tray 39 and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40; or a standalone scanner system 40.

Controller 28 includes a processor unit and associated memory 29, and may be formed as one or more Application Specific Integrated Circuits (ASICs). Memory 29 may be any volatile or non-volatile memory or combination thereof such as, for example, random access memory (RAM), read only memory (ROM), flash memory, and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuits 44, 45 may provide authentication functions, safety and operational interlocks, operating parameters and usage information related to imaging unit 32 or toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, network server, electronic tablet computer, smartphone or other hand-held electronic device, including memory 60, such as volatile or nonvolatile memory, an input device 62, such as a keyboard, and a display, such as monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include a laser scan unit (LSU) 31, an imaging unit 32, a toner cartridge 35, and a fuser 37, all mounting within imaging apparatus 22. The imaging unit 32 further includes a cleaner unit 33 housing a waste toner removal system and a photoconductive drum, and a developer unit 34 that are removably mounted within imaging unit 32. In one embodiment the cleaner unit 33 and developer unit 34 are assembled together and installed into a frame to form the imaging unit 32. The toner cartridge 35 is then installed on the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

The toner cartridge 35 removably mates with the developer unit 34 in imaging unit 32. An exit port on the toner cartridge 35 communicates with an inlet port on the developer unit 34 allowing toner to be periodically transferred from the toner cartridge 35 to resupply the toner sump in the developer unit 34.

Figure 2:
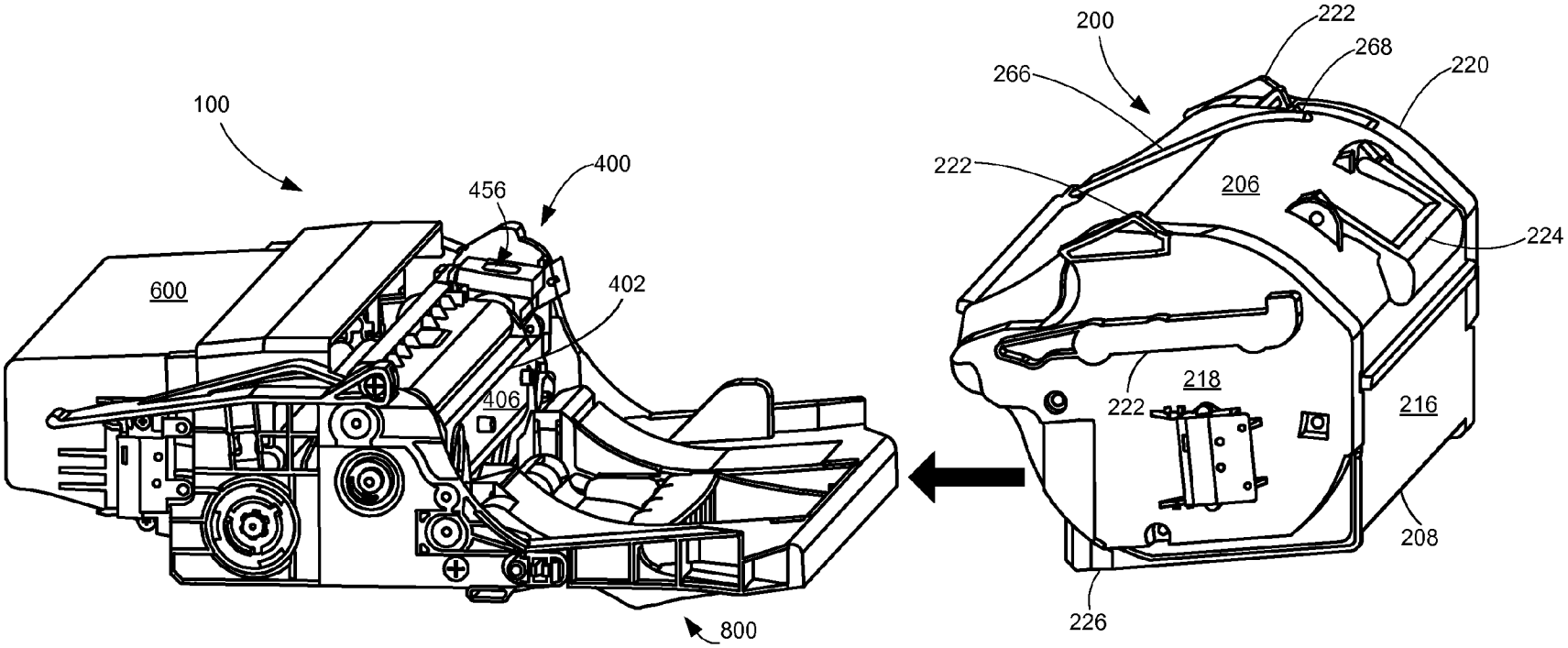
FIG. 2 is an illustration of one embodiment of an imaging unit and a toner cartridge.

Referring now to FIG. 2, an example embodiment of the imaging unit 100 is shown. Imaging unit 100, as illustrated, comprises developer unit 400, a cleaner unit 600 and a frame 800. Developer unit 400 and cleaner unit 600 are assembled together with frame 800, with toner cartridge 200 being slidably received on frame 800. The imaging unit 100 is initially slidably received in the imaging apparatus. The toner cartridge 200 is then guided by frame 800 and into operative engagement with developer unit 400. This arrangement allows the toner cartridge 200 to be removed and reinserted easily when replacing an empty toner cartridge without having to remove imaging unit 100. Should a media jam occur beneath the imaging unit 100, the toner cartridge 200 and imaging unit 100 may be readily removed to allow access to the media jam. The developer unit 400, cleaning unit 600 and frame 800 may also be readily removed and reinserted when required, however, this would normally occur with less frequency than the removal and reinsertion of toner cartridge 200.

Figure 3:
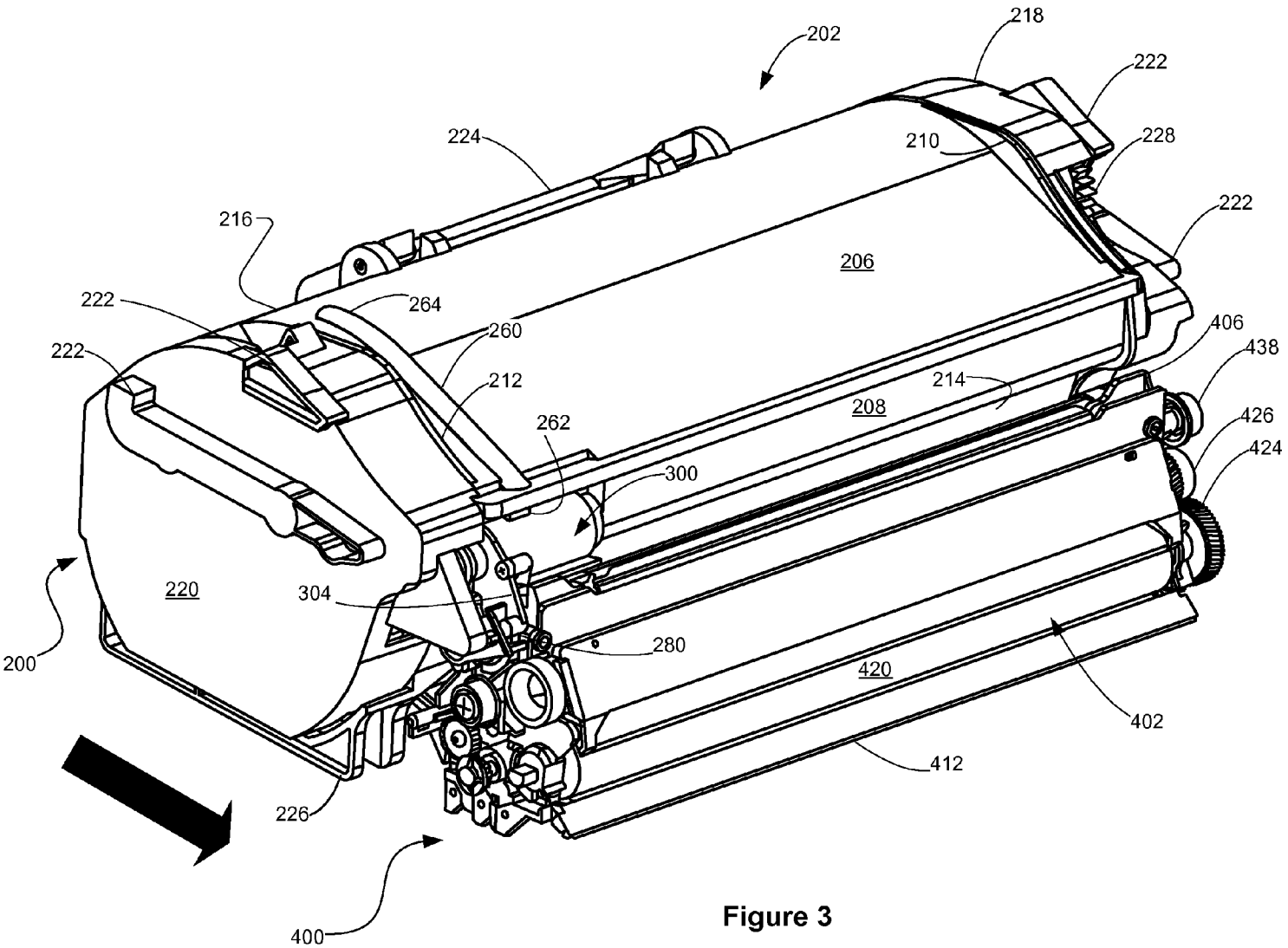
FIG. 3 is an illustration of the combination of a toner cartridge and a developer unit embodying the present invention.
Figure 4:
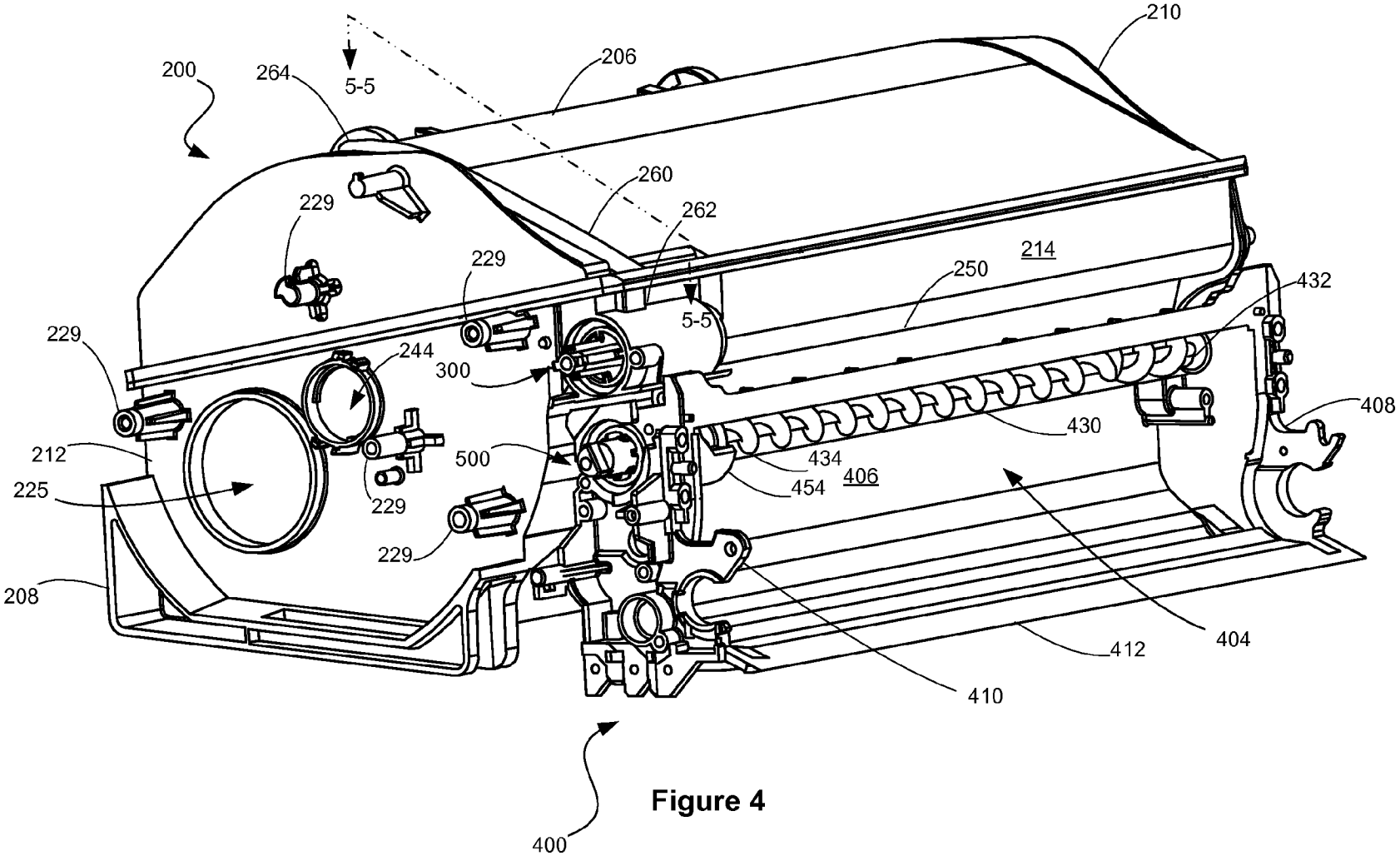
FIG. 4 is an illustration of a partially assembled developer unit shown with a partially assembled toner cartridge mounted thereon.
Figure 5:
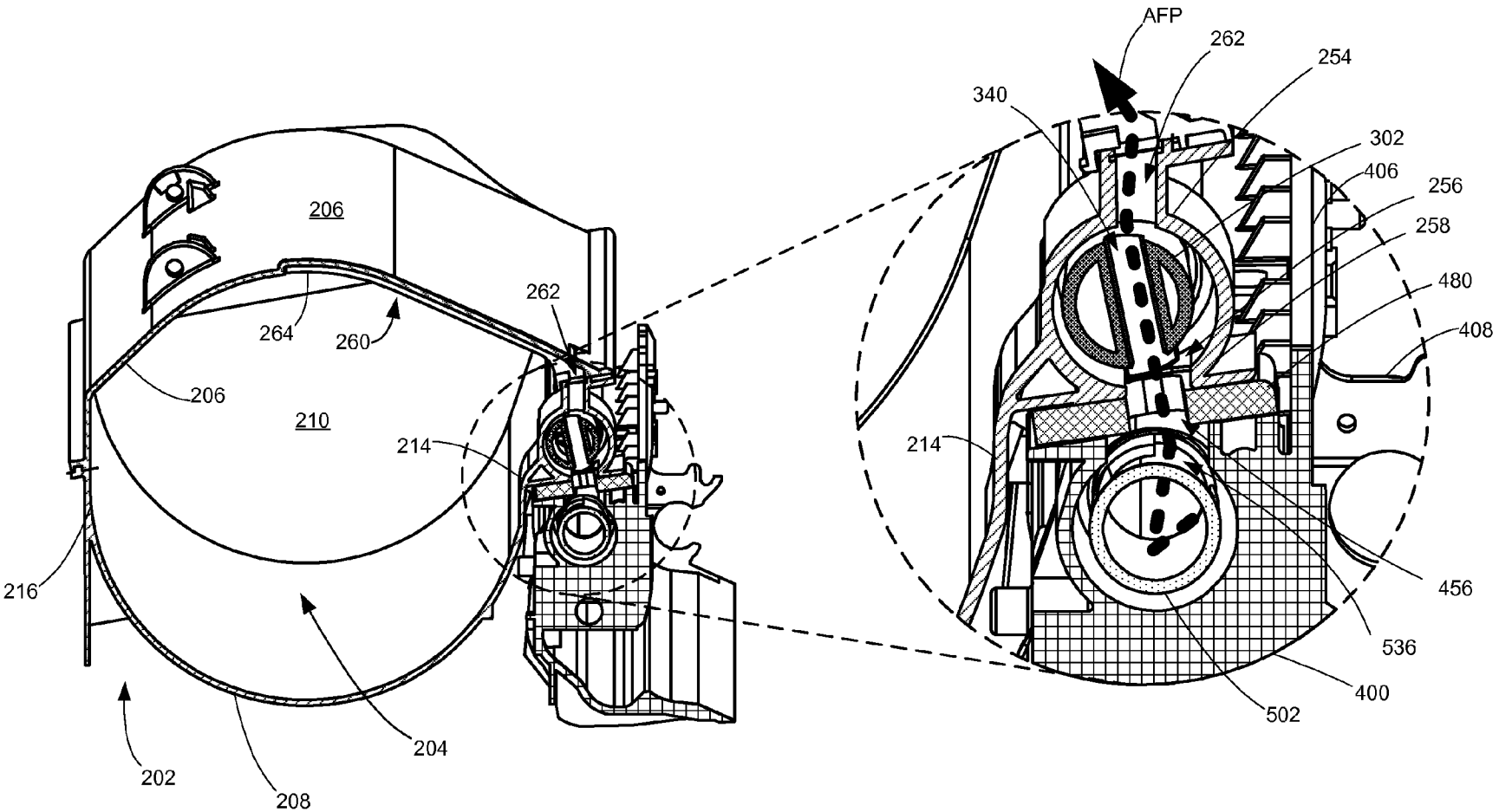
FIG. 5 is sectional view of the air flow path from the inlet port of the developer unit into the toner reservoir of the toner cartridge taken along line 5-5 in FIG. 4.

In FIGS. 3-5, an example embodiment of the toner cartridge 200 and developer unit 400 is shown. For simplicity, cleaner unit 600 and frame 800 are not shown. The large arrow shown in FIG. 3 indicates the insertion direction of the cartridge 200 into the frame 800 where it mates with developer unit 400 of the imaging unit 100. The arrow also points toward what is termed the "front" of these various elements. Toner cartridge 200 comprises a housing 202 having a reservoir 204 enclosed therein (see FIG. 5) for holding a quantity of toner. Housing 202 may be viewed as having a top or lid 206 mounted on a base 208. Base 208 includes first and second side walls 210, 212, connected to adjoining front and rear walls 214, 216. Top 206 may be ultrasonically welded to base 208 forming reservoir 204. First and second end caps 218, 220 are also mounted to housing 202 and include guides 222 to assist with supporting and inserting toner cartridge 200 for mating with developer unit 400. First and second end caps 218, 220 may be snap fitted into place or attached by screws or other forms of fasteners. Guides 222 travel in channels provided within the housing of the imaging apparatus. Guides 226 may also be provided on base 208 to assist with insertion and removal of toner cartridge 200. A handle 224 may be provided on top 206 to assist with insertion and removal of toner cartridge 200 from the imaging unit 100. A fill port 225 is provided on second side wall 212 and is used to fill toner cartridge 200 with toner. After filling, fill port 225 would be closed by a plug or cap.

Various drive gears are housed within a space formed between first end cap 218 and first side wall 210 with main interface gear 228 being visible. Various interlocks and linkages may also be housed within the space formed between second end cap 220 and second side wall 212. Mounting structures 229 may be provided on the exterior surfaces of first and second side walls 210, 212 for use with the interlocks and linkages. Main interface gear 228 engages with a drive system within imaging apparatus 22 which provides torque to main interface gear 228. A paddle is rotatably mounted within toner reservoir 204 with first and second ends of a drive shaft of the paddle extending through aligned openings 244 in the first and second side walls 210, 212, respectively. A drive gear is provided on the first end of the drive shaft of the paddle and engages with main interface gear 228 either directly or via one or more intermediate gears. First side wall 210 may also be termed the "drive" or "driven" side of toner cartridge 200.

Figure 16:
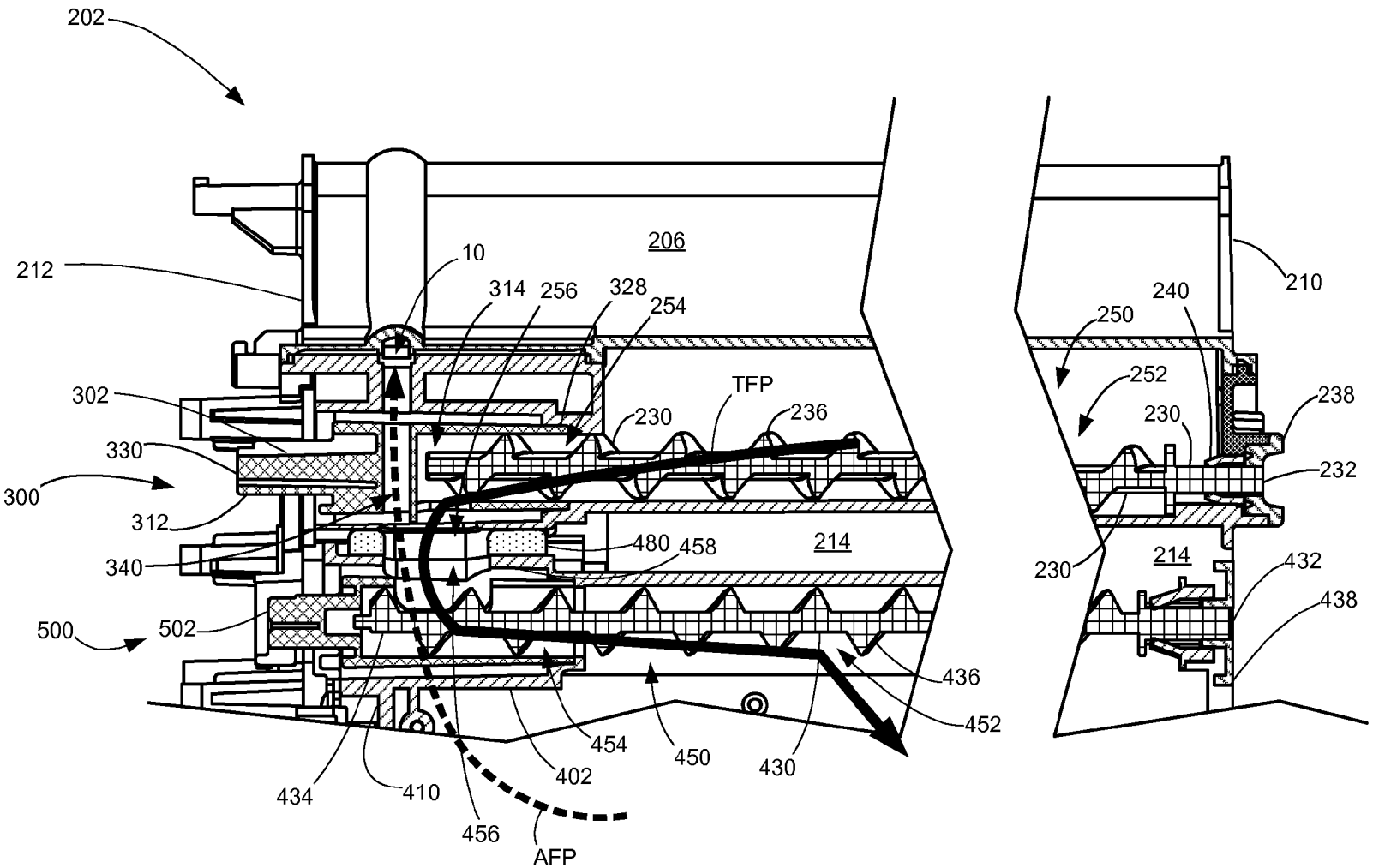
FIG. 16 is a cutaway illustration of the exit port region of the toner cartridge and the inlet port region of the developer unit of an imaging unit showing the toner feed path and the air flow path therethrough.

Referring to FIG. 16, an auger 230 having first and second ends 232, 234, and a spiral screw flight 236 is received within a channel 250 extending along the width of front wall 214 between the first and second side walls 210, 212. In one embodiment channel 250 is positioned above the axis of rotation of the drive shaft of the paddle. Channel 250 may be integrally molded as part of front wall 214 or be formed as a separate component that is attached to front wall 214. Channel 250 is generally horizontal in orientation along with toner cartridge 200 when toner cartridge 200 is installed in imaging unit 100. First end 232 of the auger 230 extends through first side wall 210 and a drive gear 238 is provided which engages with main interface gear 228 either directly or via one of more intermediate gears. A bushing 240 is provided where the first end 232 of auger 230 passes through first side wall 210. A similar bushing may be provided on each of the ends of the paddle where they pass through the first and second side walls 210, 212. Shutter assembly 300 is provided on the front wall 214 of housing 202 adjacent side wall 212 at one end of channel 250.

Figure 11:
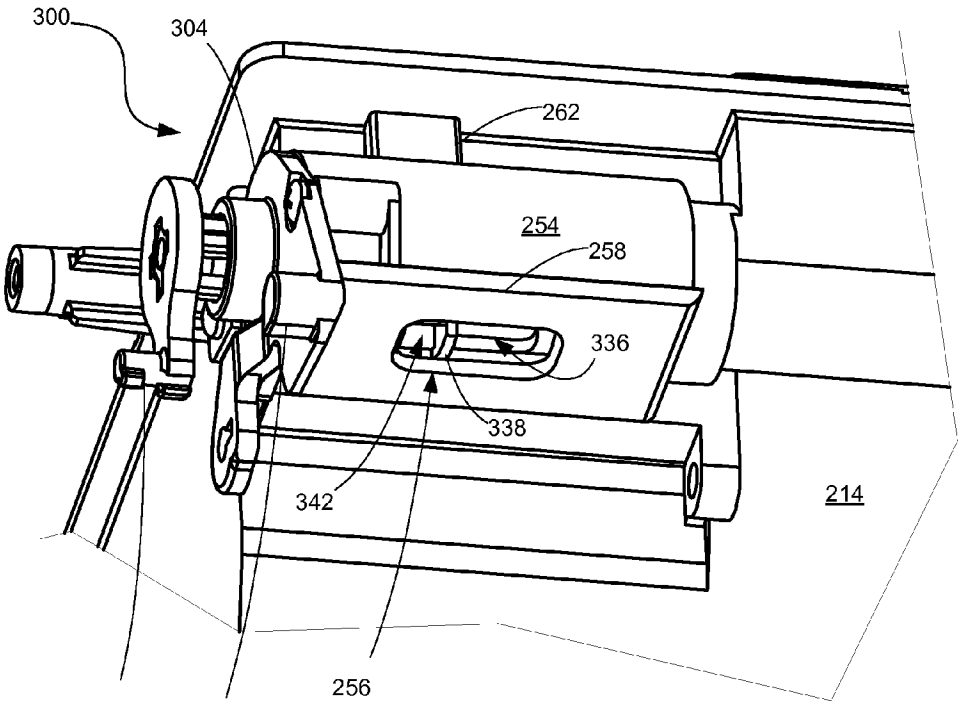
FIG. 11 is a view of the toner exit port of the toner cartridge.

Channel 250 comprises an open portion 252 and an enclosed portion 254. Open portion 252 is open to the toner reservoir 204 and extends from the first side wall 210 toward the second end 234 of auger 230. Enclosed portion 254 of channel 250 extends from the second side wall 212 and encloses a shutter 302 of shutter assembly 300 and the second end 234 of the auger 230. The paddle, as it rotates, delivers toner from the toner reservoir 204 into the first portion 252 of channel 250. Auger 230 is rotated via drive gear 238 to deliver toner received in channel 250 to the shutter 302 which is housed in the enclosed portion 254 of channel 250. An exit port 256 is provided through the wall 258 forming the enclosed portion 254 of channel 250. Shutter 302 rotates between a first position where it closes exit port 256 and a second position where exit port 256 is open. As illustrated (see also FIG. 11) exit port 256 is disposed at the bottom of channel 250 so that gravity will assist in having toner exit through exit port 256.

Figure 7:
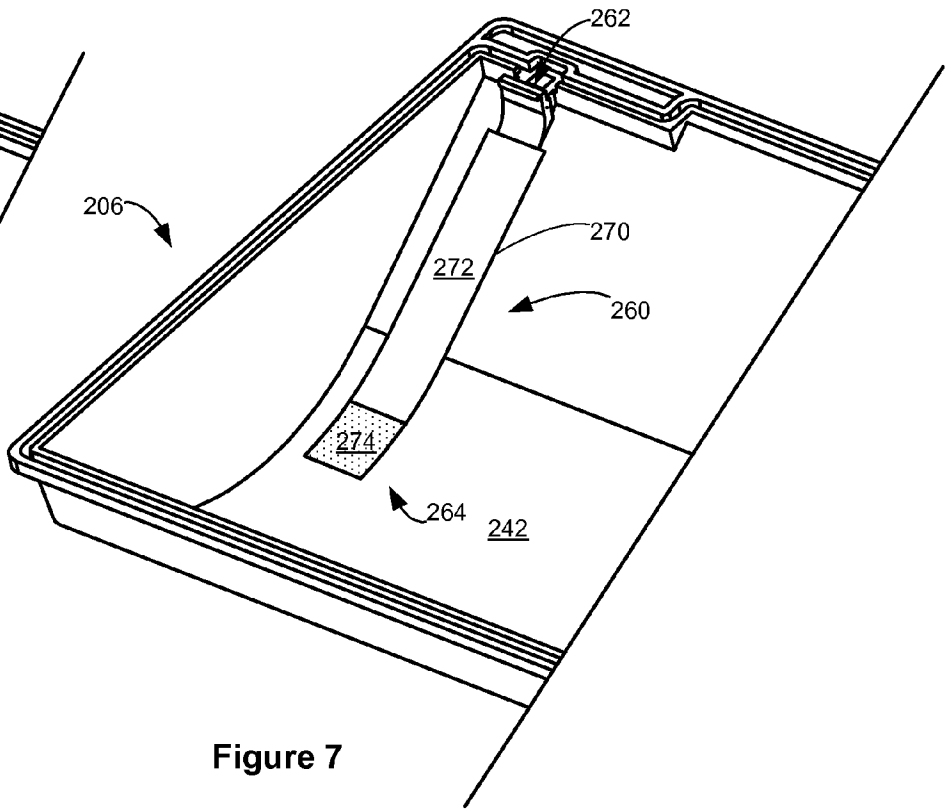
FIGS. 6 and 7 illustrate the channel for the air flow path within a lid of the toner cartridge along with one form of a reed valve.
Figure 6:
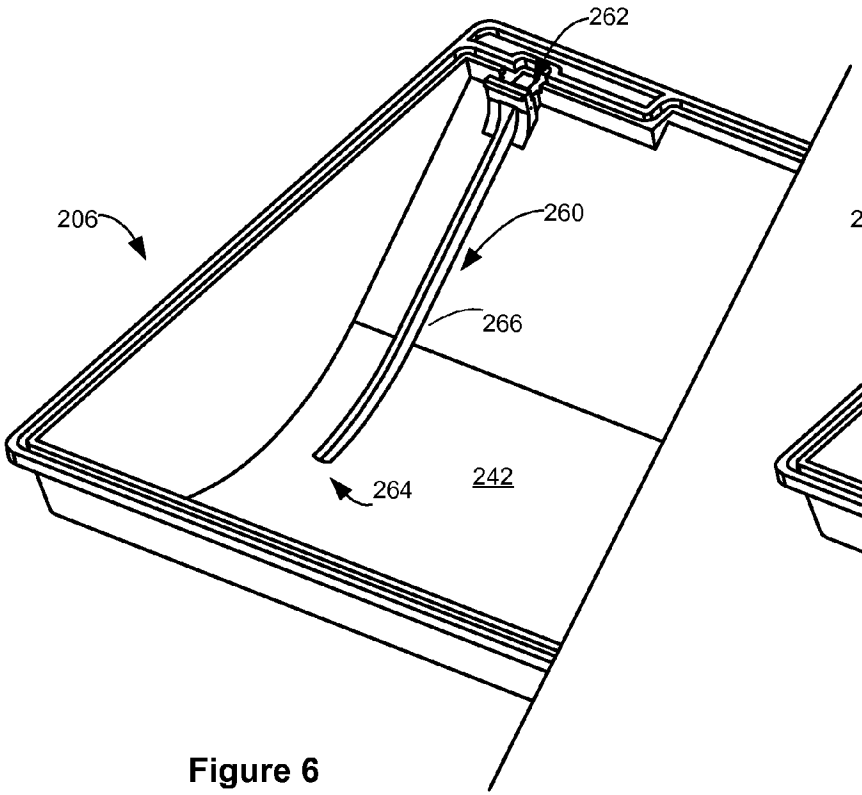

As shown in FIGS. 5-7, a passageway 260, separate from channel 250, is provided in the housing 202 from the shutter assembly 300 to the toner reservoir 204. In FIG. 5 shutter assembly 300 has not quite reached the fully opened or second position. As illustrated, passageway 260 extends between shutter assembly 300 to about the apex of the lid 206. A first end 262 of passageway is in fluid communication with the enclosed portion 254 of channel 250 while a second end 264 of passageway 260 is in fluid communication with reservoir 204 and disposed above the toner contained within the reservoir 204 to reduce possible blockage of the second end 264 of passageway 260 by the toner. Passageway 260 is routed away from the path along which toner is delivered so that it will not become blocked by toner exiting toner cartridge 200. In one form, passageway 260 is formed by an open-sided channel 266 provided on the interior surface 242 of top 206. Channel 266 is enclosed by a resilient film 270 such as MYLAR®. Film 270 has two portions, a first portion 272 having adhesive thereon for attaching film 270 to interior surface 242 to enclose channel 266, and a second portion 274 that is biased to close the second end 264 of passageway 260 but is movable to allow air traveling along passageway 260 from developer unit 400 to enter into toner reservoir 204. The resilience of film 270 provides the biasing force for second portion 274. Second portion 274 forms a moveable cover or a one way reed valve at the second end 264 of passage 260. The biased-closed moveable cover 274 or reed valve 274 prevents the entry of toner into the second end 264 of passageway 260 while allowing air to enter the toner reservoir 204. Passageway 260 may also be formed from a tube provided on the interior surface 242 with a reed valve or moveable cover 274 placed on second end 264.

An example shutter assembly 300 for the toner cartridge 200 is shown in FIGS. 8-11. Shutter assembly 300 includes a shutter 302, a retainer 304 and a lever 306. In general, lever 306 is used to move shutter 302 between a first position where the exit port 256 is closed to channel 250 and a second position where the exit port 256 is open to channel 250. A linkage (not shown) housed in second end cap 220 actuates lever 306 to move shutter 302 between the first and second positions during insertion and removal of toner cartridge 200. A stop 310 is provided on one end of the shutter 302, as shown, on drive portion 312. Stop 310 travels in a channel provided in retainer 304. The length of the channel in retainer 304 limits the travel of shutter 302 to between the first and second positions. Other forms of travel stops and other locations for the stop may be used as is known in the art.

In an example embodiment shutter 302 is generally cylindrical. Shutter 302 has a drive portion 312 and a hollow portion 314. Shutter 302 is inserted into the enclosed portion 254 of channel 250 aligning the hollow portion 314 of shutter 302 with the second end 234 of auger 230. Shutter 302 is rotatable within enclosed portion 254 of channel 250. Drive portion 312 passes through an opening 316 in retainer 304 and is rotatable within opening 316. Fasteners are inserted through openings 318 in retainer 304 and are received in corresponding openings in housing 202 rotatably securing shutter 302 in housing 202. Drive portion 312 has one or more keys 320 that are received into corresponding one or more keyways 324 in opening 322 of lever 306 to ensure proper orientation of lever 306 with shutter 302. Another fastener 308, such as a screw, passes through openings 322, 316 and is received in opening 326 provided on the end of drive portion 312 securing lever 306 to shutter 302. A connection pin 325 is provided at the distal end of lever 306 for attaching a drive linkage used for operating of lever 306. It will be realized that alternatively one or more keys may be provided on lever 306 and be received in corresponding one or more keyways provided in drive portion 312 of shutter 302. Other forms of fasteners may also be used.

Figure 9:
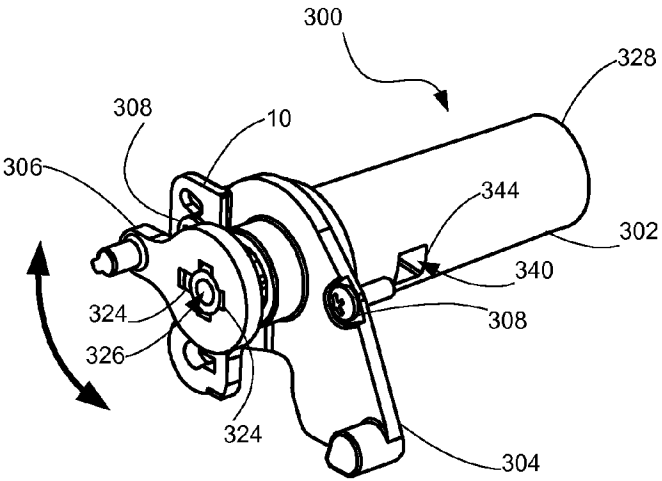
FIG. 9 is a view of the assembled shutter assembly of FIG. 8 shown in the closed position.
Figure 8:
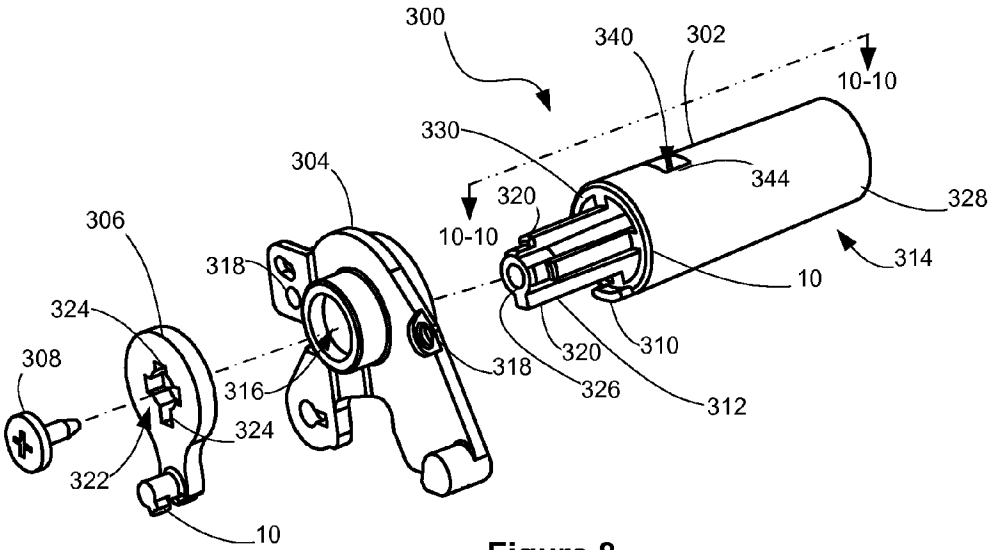
FIG. 8 is an exploded view of the example shutter assembly of the toner cartridge shown in the open position.

Hollow portion 314 extends from an inner end 328 of the shutter 302 toward an outer end 330 of the shutter 302 and has an open end 332 and a closed end 334. Open end 332 and hollow portion 314 are sized to rotatably receive the second end 234 of auger 230 and provide support for auger 230. Exit opening 336 is provided through a wall 333 of hollow portion 314. A channel 337 is formed in shutter 302 between the open end 332 and exit opening 336 through which exiting toner passes on its way to the exit port 256. When the shutter 302 is in its second or open position, rotation of auger 230 pushes toner in channel 250 through channel 337 and out exit opening 336 where it falls through exit port 256. FIG. 8 illustrates the position of shutter 302 when in its second position in toner cartridge 200 while FIG. 9 illustrates the position of shutter 302 when in its first position in toner cartridge 200.

A duct 340 having first and second ends 342, 344 passes through shutter 302 and is disposed within drive portion 312. First end 342 of duct 340 is positioned near exit opening 336. Example duct 340 is shown routed through shutter 302 along a diameter thereof and does not intersect with channel 337. However, other routings for duct 340 may be used through drive portion 312 of shutter 302. In one embodiment a deflection rib 338 is disposed near closed end 334 of hollow portion 314. Deflection rib 338 directs toner leaving exit opening 336 away from first end 342 of duct 340 and into exit port 256. Deflection rib 338 may extend into exit port 256. Deflection rib 338 helps to block exiting toner leaving exit opening 336 from entering duct 340.

Figure 10:
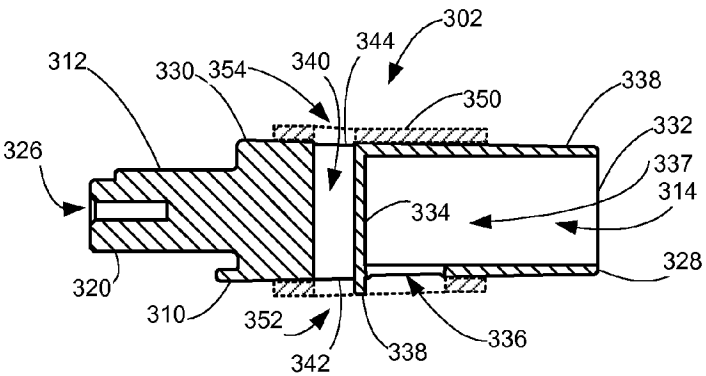
FIG. 10 is a sectional view of the shutter of FIG. 8 taken along line 10-10 of FIG. 8.

A foam seal 350 is shown in FIG. 10 wrapped around shutter 302. Foam seal 350 has openings 352, 354 therethrough. Opening 352 is disposed about both the first end 342 of duct 340 and exit opening 336 while opening 354 is disposed about second end 344 of duct 340. Foam seal 350 is used to seal the space between shutter 302 and the enclosed portion 254 of channel 250 to prevent the leakage of toner around exit port 256. As is known in the art, the ends of foam seal 350 may use wavy or irregular edges where they join together so as to inhibit toner leakage through this area.

Referring to FIGS. 3-5, 13, 14 and 16, the developer unit 400, illustrated in a partially assembled state in FIGS. 4 and 5, comprises a housing 402 having a toner sump 404 formed by a rear wall 406, first and second side walls 408, 410 and bottom 412. The cleaner unit 600, which would be in front of the developer unit 400, and frame 800 are not shown. A developer roll 420, doctor blade 422 and toner adder roll are mounted between first and second side walls 408, 410. The doctor blade 422 provides a metered uniform layer of toner on the surface of developer roll 420. The developer roll 420 and doctor blade help enclose the toner sump 404. A drive gear 424 is provided on one end of the developer roll 420. The toner adder roll, which is behind the developer roll 420, also has a driver gear on one end. Drive gear 426 mounted on first side wall 408. An auger 430 having first and second ends 432, 434, and a spiral screw flight 436 is received within a channel 450 extending along the width of and near the top of rear wall 408. First end 432 of the auger 430 extends through first side wall 408 and a drive gear 438 is provided thereon which engages with driver gear 426 either directly or via one of more intermediate gears to rotate auger 430. Drive gear 426 receives torque from the imaging apparatus and in turn drives drive gears 424, 438, as well as the toner adder roll.

Figure 15:
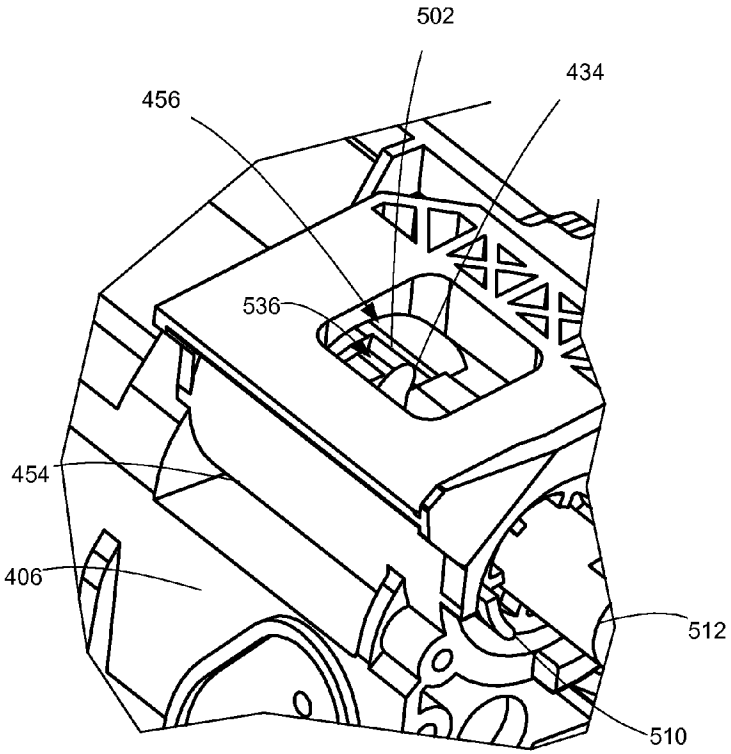
FIG. 15 is a view of the toner entry port of the developer unit.
Figure 12:
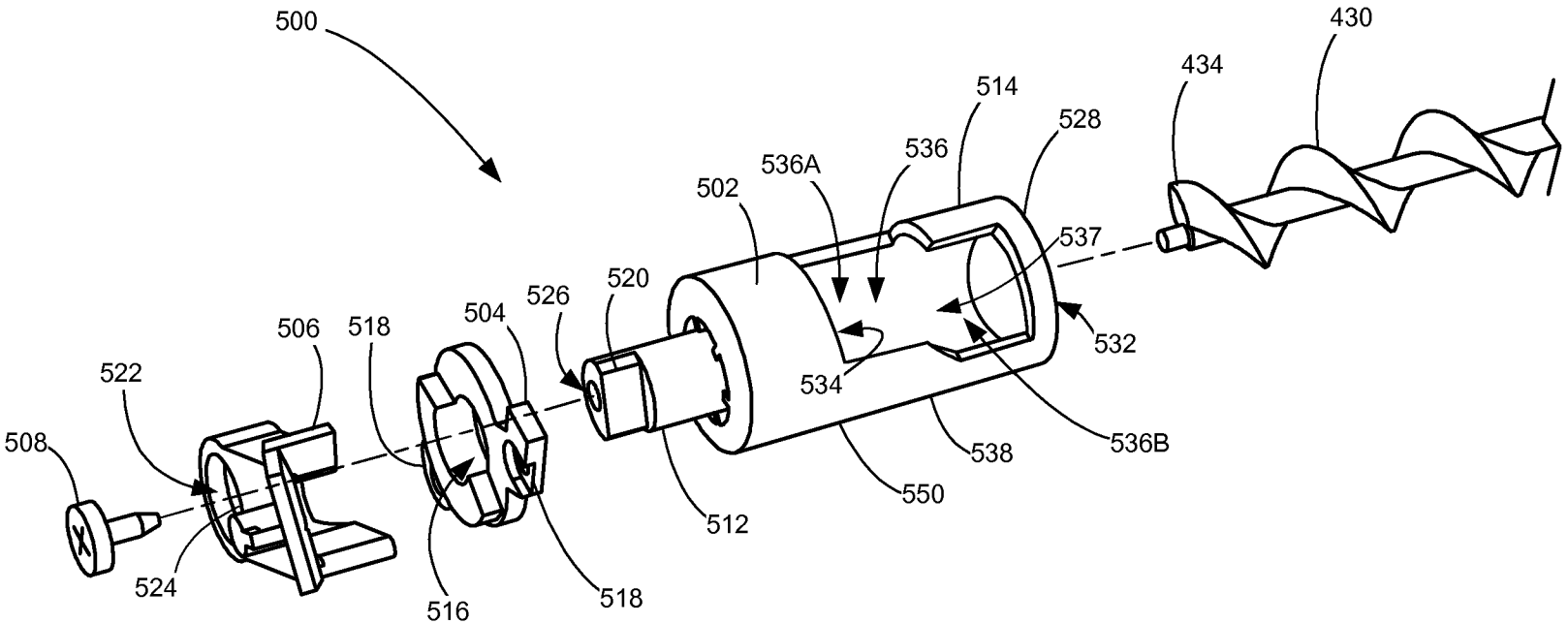
FIG. 12 is an exploded view of the example shutter assembly of the developer unit.

Channel 450 comprises an open portion 452 and an enclosed portion 454. Open portion 452 is open to the toner sump 404 and extends from the first side wall 408 toward the second end 434 of auger 430. Enclosed portion 454 of channel 450 extends from the second side wall 410 and encloses a shutter 502 of shutter assembly 500 and the second end 434 of the auger 430. A slot 455 is provided in the enclosed portion. Auger 430 is rotated via drive gear 438 to deliver toner received in shutter 502 into the open portion 452 of channel 450 and then into toner sump 404. A toner entry port 456 is provided through the wall 458 of channel 450 forming the enclosed portion 454 of channel 450. Shutter 502 rotates between a first position where it closes entry port 456 and a second position where entry port 456 is open. As illustrated (see FIG. 15) entry port 456 is disposed at the top of channel 450 so that gravity will assist in having toner drop through entry port 456.

Entry port 456 for toner (see FIG. 16) on housing 402 aligns with the exit port 256 of toner cartridge 200 when toner cartridge 200 is installed in frame 800. In one example form, entry port 456 is larger in area than exit port 256 to prevent bridging by the toner exiting toner cartridge 200 and entering developer unit 400. Below toner entry port 456, the entering toner passes through shutter 502 of shutter assembly 500 and into channel 450. The second end 434 of auger 430 extends into shutter assembly 500 to feed the entering toner along channel 450 and into toner sump 404. An arcuate member 460 having a semicylindrical portion extending along its width is attached to rear wall 406 between first side wall 408 and the enclosed portion 454 of channel 450 forming the open portion 452 of channel 450 therebetween. Arcuate member 460 has a plurality of spaced openings 462 in the semi-cylindrical portion or what is the bottom of channel 450 to allow for toner received into channel 450 to be distributed along the length of the channel and into toner sump 404 as auger 430 is rotated. The open portion 452 of channel 450 may also be formed into rear wall 406 in a similar fashion to channel 250 in toner cartridge 200. Channel 450 is disposed above the toner contained within toner sump 404 allowing the entering toner to drop into the toner sump 404.

Referring now to FIGS. 12-15, the example shutter assembly 500 includes a shutter 502, a retainer 504 and a lever 506. Shutter assembly 500 operates in a manner similar to shutter assembly 300. In general, lever 506 is used to move shutter 502 between a first position where the toner entry port 456 is closed to channel 450 and a second position where the inlet port 546 is open to channel 450. A protrusion 280 (see FIGS. 3, 11) on housing 202 actuates lever 506 to move shutter 502 between the first and second positions during insertion and removal of toner cartridge 200. A stop 510 (see FIG. 15) is provided on one end of the shutter 502, as shown, on drive portion 512. Stop 510 travels in a channel provided in retainer 504. The length of the channel in retainer 504 limits the travel of shutter 502 to between the first and second positions. Other forms of travels stops and other locations for the stop may be used as is known in the art.

Example embodiment shutter 502 is generally cylindrical. Shutter 502 has a drive portion 512 and a hollow portion 514. Shutter 502 is inserted into the enclosed portion 454 of channel 450 aligning the hollow portion 514 of shutter 502 with the second end 434 of auger 430. Shutter 502 is rotatable within enclosed portion 454 of channel 450. Drive portion 512 passes through an opening 516 in retainer 504 and is rotatable within opening 516. Fasteners, such as screws, are inserted through openings 518 in retainer 504 and are received in corresponding openings in housing 402 rotatably and axially securing shutter 502 in housing 402. Drive portion 512 has one or more keys 520 that are received into corresponding one or more keyways 524 in opening 522 of lever 506 to ensure proper orientation of lever 506 with shutter 502. Another fastener 508, such as a screw, passes through opening 522 and is received in opening 526 provided on the end of drive portion 512 securing lever 506 to shutter 502. It will be realized that alternatively one of more keys may be provided on lever 506 and be received in corresponding one or more keyways provided in drive portion 512 of shutter 502. Also other forms of fasteners may also be used.

Figure 13:
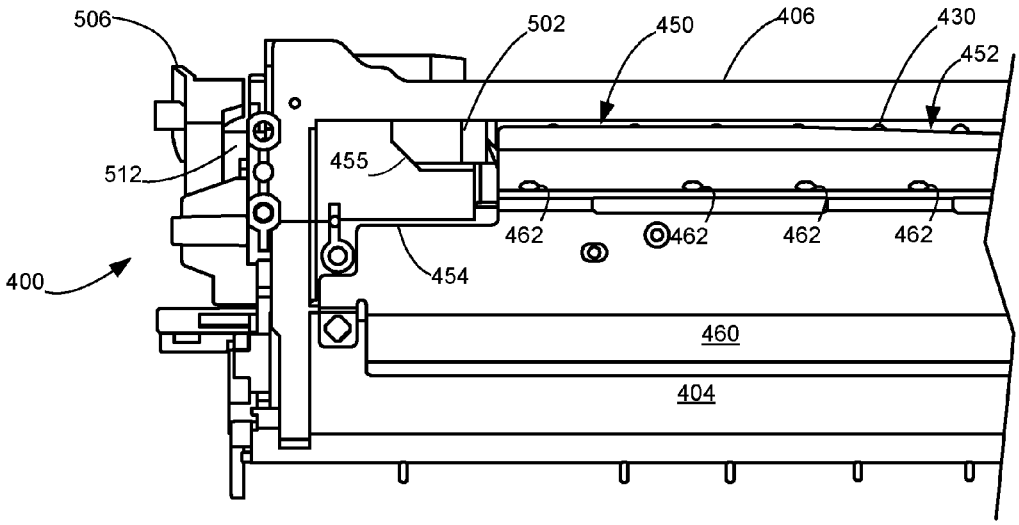
FIGS. 13 and 14 illustrate the shutter assembly of FIG. 10 in a closed position and an open position within a cutaway view of the developer unit.
Figure 14:
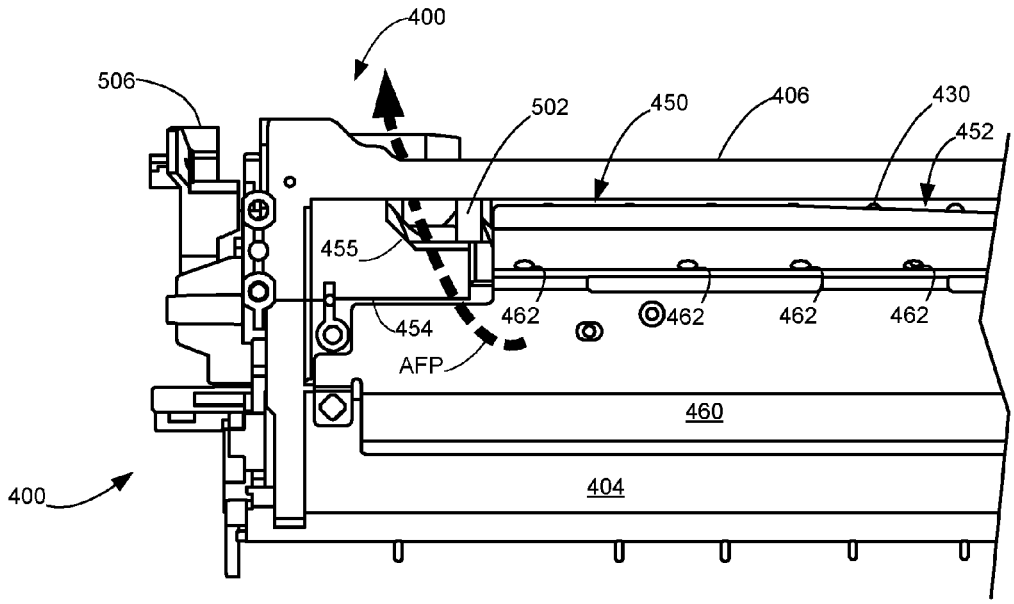

Hollow portion 514 extends from an inner end 528 of the shutter 502 toward an outer end 530 of the shutter 502 and has a open end 532 and a closed end 534. Open end 532 and hollow portion 514 are sized to rotatably receive the second end 434 of auger 430 and provide support for auger 430. Entry opening 536 is provided through a wall 538 of hollow portion 514. Example entry opening 536 is larger in area than exit opening 336 in shutter 302. Example entry opening 536 is illustrated as having to two or more radially offset or stepped sections 536A, 536B that are joined together to form entry opening 536. This arrangement of offset or stepped sections helps to prevent bridging by the entering toner and to ensure that an air flow path is maintained between the toner sump 404 and the toner entry port 456. A channel 537 is formed in shutter 502 between the open end 532 and exit opening 536 through which entering toner passes on its way to channel 450. When the shutter 502 is in its second or open position, rotation of auger 430 pulls toner from channel 537 and out open end 532 and into channel 450. With the shutter in its first or closed position, the shutter blocks slot 455 and the second end 434 of auger 430 and toner block the open end 532 of shutter 502. FIG. 13 illustrates the position of shutter 502 when in its first position or closed position in developer unit 400. When in the second or open position, stepped section 536B is aligned with slot 455 of the enclosed portion 454 of the channel 450 allowing entrapped air to follow the AFP and exit the developer housing 402 through shutter 502 and toner entry port 456. FIG. 14 illustrates the position of shutter 502 when in its second position or open position.

A foam seal, similar to form seal 350, is wrapped around shutter 502. Foam seal has an opening therethrough disposed about entry opening 536. Foam seal is used to seal the space between shutter 502 and the enclosed portion 454 of channel 450 to prevent the leakage of toner around entry port 456. As is known in the art, the ends of foam seal may use curvilinear or wavy edges where they join together creating a labyrinth joint to inhibit toner leakage through this area of the foam seal 550.

In one form, the drive and hollow portions of shutters 302, 502, taper inwardly from their respective outer ends 330, 530 towards their respective inner ends 328, 528.

FIG. 16 illustrates the toner flow path, shown as the solid arrow TFP, and air flow path, shown as the dashed arrow AFP, between the toner cartridge 200 and developer unit 400. The air flow path AFP is also shown in FIG. 5. A portion of the air flow path AFP is also shown in FIG. 14. The toner exit port 256 is aligned with toner entry port 456 when the toner cartridge 200 is installed in imaging unit 100. Both shutter assemblies 300, 500 are in their respective second or open positions. A foam seal 480 is provided on toner entry port 456 between toner entry port 456 and exit port 256. The toner flow path is from toner reservoir 204 into channel 250 through channel 337, exit opening 336 and out exit port 256 and into entry port 456 and into entry opening 536 through channel 537, out open end 532 into channel 450 into toner sump 404 of developer unit 400. The air flow path is from toner sump 404 of developer unit 400 into open end 532, entry opening 536 and or channel 537 of shutter 502 and out entry port 456 and into exit port 256 and into and through duct 340 of shutter 302 into passageway 260 and out reed valve 274. The toner in the hollow portion 314 of shutter 302 and channel 250 blocks the entry of air into the reservoir 204. The portion of the air flow path extending from exit port 256 through reed valve 274 may be termed the toner cartridge airway.

The portion of the air flow path from the toner sump 404 to entry port 456 may be termed the developer unit airway. By activating the toner cartridge airway, a vent is opened that allows air in the developer unit 400 to bypass the airflow restrictions in shutter assembly 300 and flow into the top of the toner cartridge 200. The higher pressure air in the developer unit 400 exits via the developer unit airway and enters toner cartridge 200 via the toner cartridge airway. This eliminates the vacuum or low pressure region in the toner reservoir 204 of toner cartridge 200 as toner is removed, allows for maximum toner flow from the exit port 256, and pressure equalization between the toner cartridge 200 and developer unit 400. The positioning of shutter assembly 500 in channel 450 and the positioning channel 450 and entry port 456 above the level of the toner contained within toner sump 404 helps to ensure that the developer unit airway remains clear.

To prevent a user from having to intervene with activating the toner cartridge airway, the passageway 260 is routed through the duct 340 of cartridge shutter 302. One advantage of this routing is that if the toner cartridge airway runs through shutter 302 of toner cartridge 200, when the toner cartridge 200 is removed, the toner therein is double sealed by the reed valve 274 and shutter 302. This prevents toner from leaking out of the cartridge during drop testing or shipping. Another advantage is that by having the toner cartridge airway run through the shutter 302 and exit port 256 locates the duct 340 directly over the developer unit toner entry port 456. This connects the duct 340 and passageway 260 to the developer unit 400 using preexisting connections, eliminating user intervention and eliminating the need to have a separate airway opening in each of the toner cartridge 200 and developer unit 400 unit which may provide another path for toner leakage. When the user installs the toner cartridge 200 into the imaging unit 100, a linkage is moved by the toner cartridge 200 actuating shutter assembly 500 and moving shutter 502 into its second or open position. When the toner cartridge 200 is fully seated in the imaging unit 100, a door over that toner cartridge 200 can then be closed by a user and a rod or plunger on the interior of the door actuates shutter assembly 300 and moving shutter 302 into its second or open position. At this time the toner cartridge airway and the developer unit airway are activated with both shutter assemblies 300, 500 being in their respective open positions.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An assembly for an imaging device, the assembly comprising:

a developer unit and a toner cartridge, the developer unit and the toner cartridge being positionable so as to be in fluid communication with one another;

the developer unit comprising:

a developer housing having a toner sump therein for holding a first quantity of toner, the developer housing having an entry port for receiving toner exiting the toner cartridge; and a developer shutter mounted on the developer housing and moveable between a first position where the entry port is closed and a second position where the entry port is in fluid communication with the toner sump;

and the toner cartridge comprising:

a cartridge housing having a reservoir enclosed therein for holding a second quantity of toner, the cartridge housing having an exit port in communication with the reservoir for receiving toner exiting the toner cartridge;

a cartridge shutter mounted on the cartridge housing and having a toner path through the cartridge shutter, the cartridge shutter moveable between a first position where the toner path is closed to the exit port preventing toner from exiting and a second position where the toner path is open to the exit port allowing toner to exit, the cartridge shutter having an air duct therethrough separated from the toner path, the air duct having a first end in fluid communication with the exit port when the cartridge shutter is in the second position; and a passageway in the cartridge housing having a first end in fluid communication with a second end of the air duct when the cartridge shutter is in the second position and a second end in fluid communication with the reservoir;

wherein, when the exit port of the toner cartridge is aligned with the entry port of the developer unit and the developer and cartridge shutters are in their respective second positions, toner leaves the toner cartridge through the toner path through the cartridge shutter and the exit port and enters the developer unit through the entry port while air entrained within the toner sump of the developer unit exits via the entry port and enters the reservoir of the toner cartridge via the exit port, the air duct and the passageway thereby equalizing pressure between the toner cartridge and the developer unit.

2. The assembly of claim 1, wherein a moveable cover is provided on the second end of the passageway and biased to close the second end of the passageway to prevent toner within the reservoir from entering the passageway, the moveable cover being openable by the air entering the reservoir from the developer unit.

3. The assembly of claim 2, wherein the moveable cover comprises a reed valve.

4. The assembly of claim 2, wherein the passageway further comprises:

an open-sided channel formed in the cartridge housing; and a resilient film strip enclosing the open-sided channel, the film strip having a first portion and a second portion, the first portion having an adhesive adhering the film strip to the cartridge housing and the second portion at the second end of the passageway forming the moveable cover.

5. The assembly of claim 1, wherein the passageway is provided in a top of the cartridge housing with the second end positioned above the second quantity of toner within the reservoir.

6. The assembly of claim 1, wherein the cartridge shutter includes:

a drive portion and a hollow portion, the drive portion connectable to a lever for rotating the cartridge shutter between the first and second positions;

the hollow portion extending from an inner end of the cartridge shutter toward an outer end of the cartridge shutter, the hollow portion having a first open end and a second closed end and an exit opening through a wall of the hollow portion adjacent the second closed end wherein exiting toner enters the first open end of the hollow portion and exits through the exit opening when the cartridge shutter is in the second position such that the first open end, the hollow portion and the exit opening form the toner path through the cartridge shutter.

7. The assembly of claim 6, wherein the air duct is positioned between the second closed end of the hollow portion and the outer end of the cartridge shutter.

8. The assembly of claim 6, further comprising a deflector rib at the second closed end of the hollow portion, a portion of the deflector rib extending radially outward from the cartridge shutter to direct the exiting toner into the exit port and away from the first end of the air duct.

9. The assembly of claim 1, wherein the developer shutter includes:

a drive portion and a hollow portion, the drive portion connectable to a lever for rotating the developer shutter between the first and second positions; and the hollow portion extending from an inner end of the developer shutter toward an outer end of the developer shutter, the hollow portion having a first open end and a second closed end and an entry opening through a wall of the hollow portion wherein toner enters the entry opening passing through the hollow portion and the first open end and into the toner sump when the developer shutter is in the second position.

10. A toner cartridge for use in an imaging device, comprising:

a housing having a reservoir enclosed therein for holding a quantity of toner, the housing having an exit port in communication with the reservoir for exiting toner from the toner cartridge;

a shutter mounted on the housing and having a toner path through the shutter, the shutter moveable between a first position where the toner path is closed to the exit port preventing toner from exiting and a second position where the toner path is open to the exit port allowing toner to exit, the shutter having an air duct therethrough separated from the toner path, the air duct having a first end in fluid communication with the exit port when the shutter is in the second position; and a passageway in the housing having a first end in fluid communication with a second end of the air duct when the shutter is in the second position and a second end in fluid communication with the reservoir such that air received through the exit port from outside the toner cartridge when the shutter is in the second position enters the reservoir of the toner cartridge via the air duct and the passageway.

11. The toner cartridge of claim 10, wherein a moveable cover is provided on the second end of the passageway and biased to close the second end of the passageway to prevent toner within the reservoir from entering the passageway, the moveable cover being openable by the air entering the reservoir.

12. The toner cartridge of claim 11, wherein the moveable cover comprises a reed valve.

13. The toner cartridge of claim 11, wherein the passageway further comprises:

an open-sided channel formed in the housing; and a resilient film strip enclosing the open-sided channel, the film strip having a first portion and a second portion, the first portion having an adhesive adhering the film strip to the housing and the second portion at the second end of the passageway forming the moveable cover.

14. The toner cartridge of claim 10, wherein the passageway is provided in a top of the housing with the second end positioned above the quantity of toner within the reservoir.

15. The toner cartridge of claim 10, wherein the shutter includes:

a drive portion and a hollow portion, the drive portion connectable to a lever for rotating the shutter between the first and second positions;

the hollow portion extending from an inner end of the shutter toward an outer end of the shutter, the hollow portion having a first open end and a second closed end and an exit opening through a wall of the hollow portion adjacent the second closed end wherein exiting toner enters the first open end of the hollow portion and exits through the exit opening when the shutter is in the second position such that the first open end, the hollow portion and the exit opening form the toner path through the shutter.

16. The toner cartridge of claim 15, wherein the air duct is positioned between the second closed end of the hollow portion and the outer end of the shutter.

17. The toner cartridge of claim 15, further comprising a deflector rib at the second closed end of the hollow portion, a portion of the deflector rib extending radially outward from the shutter to direct the exiting toner into the exit port and away from the first end of the air duct.

* * * * *